US010071007B2

(12) United States Patent
Williams et al.

(10) Patent No.: US 10,071,007 B2
(45) Date of Patent: Sep. 11, 2018

(54) SLING FOR ROTATING AN INDIVIDUAL

(71) Applicant: Liko Research & Development AB, Luleå (SE)

(72) Inventors: Joshua A. Williams, West Harrison, IN (US); Neal Wiggermann, Batesville, IN (US)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 224 days.

(21) Appl. No.: 15/016,352

(22) Filed: Feb. 5, 2016

(65) Prior Publication Data

US 2016/0256340 A1 Sep. 8, 2016

Related U.S. Application Data

(60) Provisional application No. 62/128,783, filed on Mar. 5, 2015.

(51) Int. Cl.
*A61G 1/013* (2006.01)
*A61G 1/044* (2006.01)
(Continued)

(52) U.S. Cl.
CPC ..... *A61G 7/1023* (2013.01); *A61G 1/013* (2013.01); *A61G 7/001* (2013.01); *A61G 7/10* (2013.01);
(Continued)

(58) Field of Classification Search
CPC .. A61G 7/1023; A61G 7/1036; A61G 7/1051; A61G 7/1086; A61G 7/109
See application file for complete search history.

(56) References Cited

U.S. PATENT DOCUMENTS 722,456 A 3/1903 Reeves
2,489,828 A * 11/1949 Springer ..... A61G 1/01 5/625
(Continued)

FOREIGN PATENT DOCUMENTS

CA 2 232 406 A1 11/1999
GB 2 248 817 A 4/1992

OTHER PUBLICATIONS

Kousouretas, Ioannis; European Search Report; dated Jun. 16, 2016; 6 pages; European Patent Office.
(Continued)

*Primary Examiner* — Robert G Santos
*Assistant Examiner* — Rahib T Zaman
(74) *Attorney, Agent, or Firm* — Dinsmore & Shohl LLP

(57) ABSTRACT

Slings for rotation of individuals are disclosed herein. In various embodiments, a sling includes a central support section supporting at least a torso of the individual, a superior support section disposed along a first side of the central support section, an inferior support section disposed along a second side of the central support section opposing the superior support section, and straps extending from each lateral side of the central support section. The superior support section includes an anterior support flap and a posterior support flap, and at least a portion of the posterior support flap is separated from at least a portion of the anterior support flap. A central axis bisects the superior support section, the central support section, and the inferior support section such that the sling is foldable about the central axis, and the central axis acts as a fulcrum for rotating the individual.

21 Claims, 7 Drawing Sheets

(51) Int. Cl.

| | |
|---|---|
| ***A61G 7/10*** | (2006.01) |
| ***A61G 1/00*** | (2006.01) |
| ***A61G 5/00*** | (2006.01) |
| ***A61G 7/14*** | (2006.01) |
| ***A61G 7/00*** | (2006.01) |

(52) U.S. Cl.
CPC ..... *A61G 7/1051* (2013.01); *A61G 2200/34* (2013.01)

(56) References Cited

U.S. PATENT DOCUMENTS 4,180,879 A 1/1980 Mann
4,211,218 A * 7/1980 Kendrick ..... A61F 5/05883 128/870
4,450,991 A * 5/1984 Gougeon ..... A47D 13/025 224/159
4,748,701 A * 6/1988 Marlowe ..... A61G 7/1019 5/89.1
5,155,874 A 10/1992 Kershaw
5,442,821 A * 8/1995 Weeks ..... A61G 1/01 5/627
5,673,443 A 10/1997 Marmor
6,092,525 A 7/2000 Church
6,289,534 B1 * 9/2001 Hakamiun ..... A61G 7/1017 5/83.1
6,560,793 B2 5/2003 Walker
6,658,676 B1 12/2003 Persson
6,851,145 B2 * 2/2005 Smith ..... A61G 1/01 5/625
7,818,836 B2 * 10/2010 Stinson ..... A61G 7/001 5/487
8,065,765 B2 * 11/2011 Rincon ..... A61G 1/01 5/625
8,281,430 B1 10/2012 Hough et al.
8,813,276 B2 8/2014 Lee et al.
8,984,681 B2 * 3/2015 Ponsi ..... A61G 7/001 128/845
9,283,129 B1 * 3/2016 Pifer ..... A45F 4/06
2003/0192118 A1 * 10/2003 Carbonneau ..... A61G 7/10 5/89.1
2005/0103350 A1 5/2005 Henry
2005/0132495 A1 * 6/2005 Girard ..... A61G 1/01 5/625
2008/0028516 A1 * 2/2008 Morishima ..... A61G 7/1051 5/89.1
2008/0189853 A1 * 8/2008 Felling ..... A61G 7/1023 5/89.1
2013/0270881 A1 * 10/2013 Fowler ..... A61G 7/1023 297/219.1

OTHER PUBLICATIONS

Solo RepoSheet™ Generous, Instruction Guide 7EN161108-01, Liko AB, www.Liko.com, pp. 1-4, (Apr. 2011).
RepoSheete Original, Instruction Guide 7EN160156-05, Liko Ab, www.Liko.com, pp. 1-6, (Dec. 2011).

* cited by examiner

SLING FOR ROTATING AN INDIVIDUAL

CROSS-REFERENCE TO RELATED APPLICATIONS

The present application claims priority to U.S. Provisional Patent Application Ser. No. 62/128,783 filed Mar. 5, 2015 and entitled "Sling for Rotating an Individual," the entirety of which is incorporated by reference herein.

FIELD

The present specification generally relates to slings and, more particularly, to slings for rotating an individual.

BACKGROUND

Medical and rehabilitation providers recognize benefits in proning individuals, such as for respiratory issues or pressure ulcer management. Unfortunately, conventional methods for proning individuals are physically demanding, time consuming, and may be medically challenging. A common technique in conventional practice is to reposition an individual laterally on the edge of the bed using a repositioning sheet and manually rotate the individual, using the repositioning sheet to "catch" the individual as they roll over. This technique is labor intensive and may require multiple caregivers to facilitate proning.

Accordingly, a need exists for alternative slings for rotating individuals, such as slings which support an individual along the anterior and posterior sides of the body during the rotation.

SUMMARY

According to some embodiments of the present disclosure, a sling for rotating an individual is provided that includes a central support section supporting at least a torso of the individual; a superior support section disposed along a first side of the central support section; an inferior support section disposed along a second side of the central support section opposing the superior support section; straps extending from each lateral side of the central support section; and a central axis that bisects the superior support section, the central support section, and the inferior support section such that the sling is foldable about the central axis, the central axis acting as a fulcrum for rotating the individual about a midaxillary line of the individual. The superior support section includes an anterior support flap and a posterior support flap. At least a portion of the posterior support flap is separated from at least a portion of the anterior support flap. Each of the straps may include an end loop for coupling the sling to a lift mechanism. In embodiments, the superior support section may include a fastening mechanism to releasably secure the anterior support flap and the posterior support flap. In embodiments, the inferior support section may include a fastening mechanism to releasably secure the inferior support section of the sling to itself.

According to some embodiments of the present disclosure, a method of rotating an individual is provided that includes positioning a sling between the individual and a surface upon which the individual is disposed. The sling includes a central support section supporting at least a torso of the individual; a superior support section disposed along a first side of the central support section; an inferior support section disposed along a second side of the central support section opposing the superior support section; at least one strap extending from each lateral side of the central support section; and a central axis that bisects the superior support section, the central support section, and the inferior support section. Each strap includes an end loop for coupling the sling to a lift mechanism. The superior support section includes an anterior support flap and a posterior support flap. At least a portion of the posterior support flap is separated from at least a portion of the anterior support flap. In embodiments, the superior support section may also include a fastening mechanism to releasably secure the anterior support flap and the posterior support flap. In embodiments, the inferior support section includes a fastening mechanism to releasably secure the inferior support section of the sling to itself and around a portion of a leg of the individual. According to various embodiments, the sling is positioned such that the central axis is aligned such that the central axis is not within the mid-sagittal plane of the individual. In embodiments, the method may further include securing the fastening mechanism of the superior support section to releasably secure the anterior support flap and the posterior support flap to one another. In embodiments, the method may further include securing the fastening mechanism of the inferior support section to releasably secure the inferior support section of the sling to itself and around the portion of the first leg of the individual. The sling and the individual are lifted with the at least one strap extending from each lateral side of the central support section such that at least a portion of the individual partially contacts the surface upon which the individual is disposed. The central axis acts as a fulcrum for rotating the individual, wherein, as the individual is lifted, the individual is rotated about a vertical axis of the individual within a parasagittal plane of the individual.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

Referring now to the illustrative examples in the drawings, wherein like numerals represent the same or similar elements throughout.

DETAILED DESCRIPTION

Figure 1:
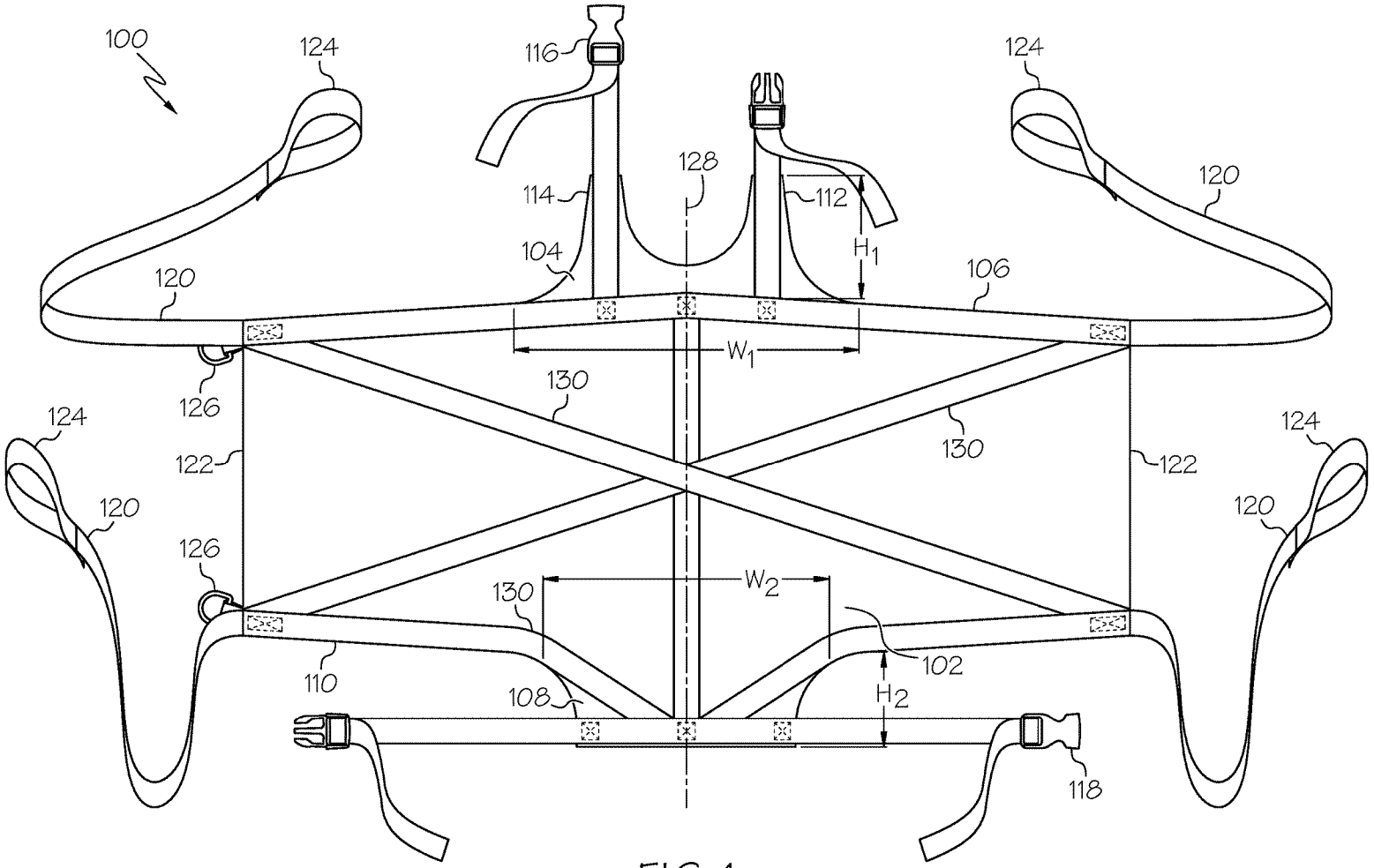
FIG. 1 schematically depicts a sling for rotating an individual according to one or more embodiments.

FIG. 1 generally depicts one embodiment of a sling for rotating an individual.

The sling generally comprises a central support section, a superior support section along a first side of the central support section, an inferior support section along a second side of the central support section opposing the superior support section, straps for coupling the sling to a lift mechanism, and a central axis bisecting the superior support section, the central support section, and the inferior support section such that the sling is foldable about the central axis. The central axis acts as a fulcrum for rotating the individual about a midaxillary line of the individual. Various embodiments of the sling and the operation of the sling will be described in more detail herein.

A sling 100 according to various embodiments is depicted in FIG. 1. As shown in FIG. 1, the sling 100 includes a central support section 102, a superior support section 104 along a first side 106 of the central support section 102, and an inferior support section 108 along a second side 110 of the central support section 102 opposing the superior support section 104. The superior support section 104 includes an anterior support flap 112, a posterior support flap 114, and a fastening mechanism 116 for joining the anterior support flap 112 and the posterior support flap 114.

Figure 3:
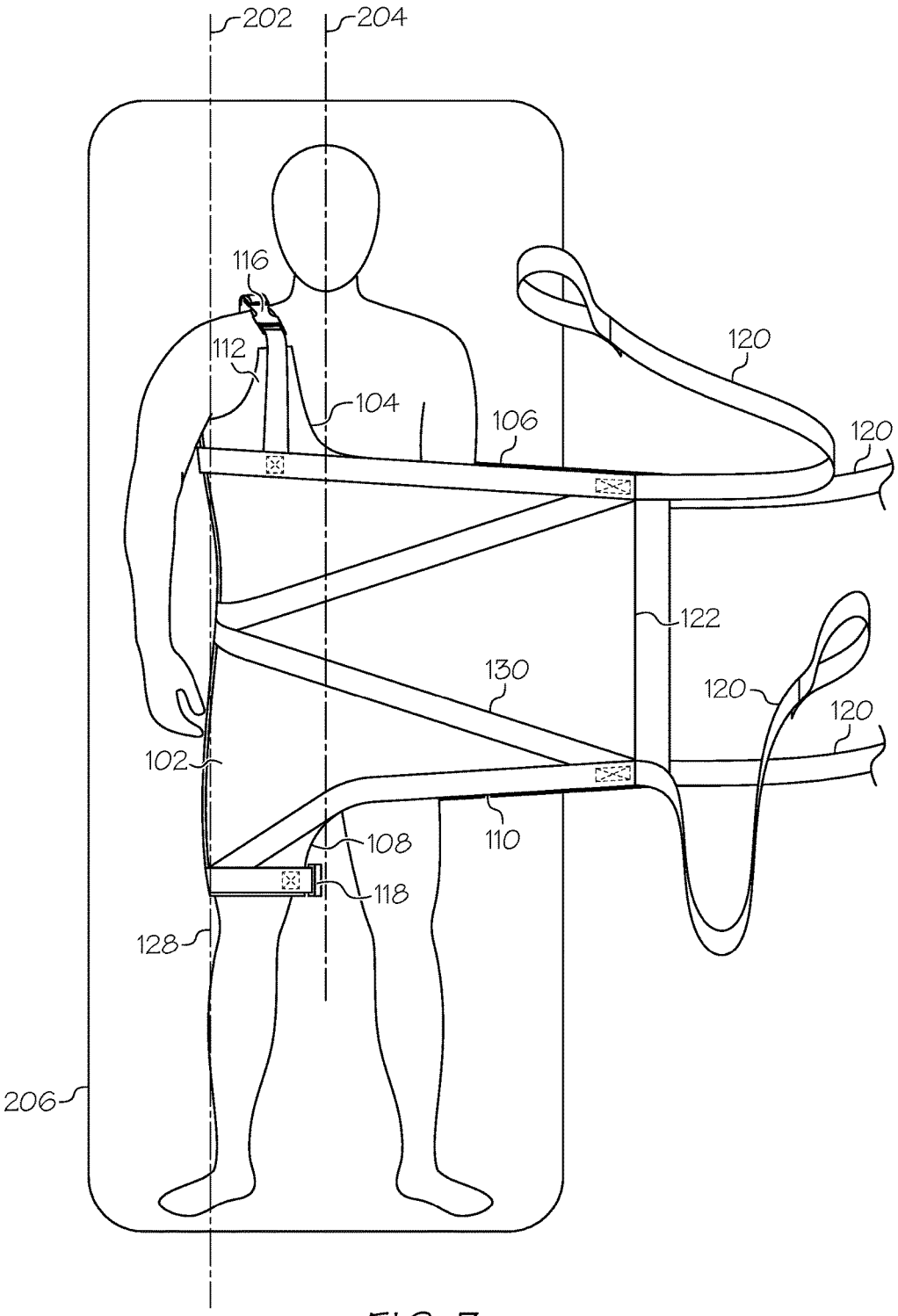
FIG. 3 schematically depicts a sling secured about an individual prior to rotation according to one or more embodiments.

The inferior support section 108 includes a fastening mechanism 118 to releasably secure the inferior support section of the sling 100 to itself and around a portion of a leg of an individual (i.e., as shown in FIG. 3). Fastening mechanism 116 and fastening mechanism 118 may be the same type of fastening mechanism. Alternatively, fastening mechanism 116 may be of a different type of fastening mechanism than fastening mechanism 118. In various embodiments, fastening mechanisms 116 and 118 may include a buckle and clip fastener, as depicted in FIG. 1. However, in other embodiments, the fastening mechanisms 116 and 118 can include ladder lock buckles, hooks and loops (e.g. VELCRO®), snaps, buttons, zippers, straps and rings, or any other suitable fastening mechanism for joining two discrete portions of strapping and/or material. The fastening mechanisms 116 and 118 of various embodiments include fastening mechanisms that are adjustable so as to enable the fastening mechanisms 116 and 118 to be adapted for use on individuals of various sizes. In various embodiments, when the fastening mechanisms 116 and 118 are engaged, the superior support section 104 and the inferior support section 108 are secured about the individual such that the superior support section 104 and the inferior support section 108 generally conform to the individual. In various embodiments, the superior support section 104 and the inferior support section 108 are secured about the individual effective to maintain the individual in position with respect to the sling 100 during rotation of the individual.

In various embodiments, the superior support section 104 extends from the first side 106 of the central support section 102 a first height H1. In embodiments, the first height H1 is approximately equal to an average distance between the bottom of the scapula and the top of the shoulder of an individual. For example, in embodiments, the superior support section 104 may extend from the first side 106 of the central support section 102 to a first height H1 from about 10 cm to about 30 cm. The dimensions of the superior support section 104 can vary depending on the particular embodiment, but should be such that the superior support section 104 provides sufficient support to the shoulder of the individual during rotation. For example, when the first side 106 of the central support section 102 is positioned below the axilla of an individual and extends along a transverse plane of the individual, the superior support section 104 extends to a height sufficient to enable the anterior support flap 112 and the posterior support flap 114 to be joined over the shoulder of the individual using the fastening mechanism 116.

The superior support section 104 also has a width W1 extending along the first side 106 of the central support section 102. The width W1 of the superior support section 104 can vary along the height of the superior support section 104. For example, in some embodiments, the width W1 of the superior support section 104 proximate the first side 106 may be greater than the width of the superior support section 104 distal the first side 106. That is, the width W1 of the superior support section 104 tapers with increasing distance from the first side 106 of the sling 100. The width W1 of the superior support section 104 may vary depending on the particular embodiment, but should generally be narrow enough to ensure that the superior support section 104 does not exert pressure on or otherwise irritate a neck of the individual.

In various embodiments, when the anterior support flap 112 and the posterior support flap 114 are joined using the fastening mechanism 116, an armhole is formed. The circumference of the armhole can vary depending on the particular embodiment, but should be large enough to accommodate individuals of various sizes. In some embodiments, the circumference of the armhole can be varied by adjusting the fastening mechanism 116.

The inferior support section 108 extends from the second side 110 of the central support section 102 to a height H2. In embodiments, the height H2 may be from about 15 cm to about 30 cm or greater. The height H2 of the inferior support section 108 can vary depending on the particular embodiment, and can extend from approximately below a hip or a gluteal sulcus of an individual positioned on the central portion 102 of the sling 100 to an area near the middle of a thigh, a knee, or a calf of the individual.

The inferior support section 108 also has a width W2 extending along the second side 110 of the central support section 102. The width W2 of the inferior support section 108 may vary depending on the particular embodiment, but should generally be wide enough to at least partially encircle a portion of a leg of the individual.

Still referring to FIG. 1, the sling 100 includes straps 120 extending from each lateral side 122 of the central support section 102. Each strap 120 includes an end loop 124 for coupling to a lift mechanism. For example, the lift mechanism may include one or more hooks to which the end loops 124 are secured to couple the sling 100 to the lift mechanism. In some embodiments, a ring 126 is positioned along at least one of the straps 120 and receives another one of the straps 120 extending from an opposing lateral side to facilitate drawing the lateral sides 122 towards one another. In such embodiments, a strap on the opposing lateral side may be threaded through the ring 126 positioned along the corresponding strap 120 before the end loops 124 are coupled to the lift mechanism to secure the central support section around the torso of the individual.

In various embodiments, straps 120 extend from each lateral side 122 proximate the first side 106 of the central support section 102, and from each lateral side 122 proximate the second side 110 of the central support section 102. Although the embodiments depicted in FIGS. 1-5 include four straps, it is to be understood that some embodiments may include a greater or fewer number of straps. For example, some embodiments may include a strap that connects to each lateral side 122 proximate both the first side 106 and the second side 110 of the central support section 102 such that there is one strap on each lateral side. A loop may be positioned near the center of each strap for coupling the sling 100 to the lift mechanism, or the strap may not include a loop for coupling to the lift mechanism. In other embodiments, additional straps may be utilized along each lateral side 122.

In some embodiments, the superior support section 104 and the inferior support section 108 do not include fastening mechanisms 116 and 118. In these embodiments, the sling 100 may be cinched about the individual effective to maintain the individual in position with respect to the sling 100 during rotation of the individual. For example, in these embodiments, the straps 120 may include one or more buckles or cinch mechanisms such that one strap 120 may be threaded through a buckle or cinch mechanism associated with the strap 120 on the opposing lateral side and tightened around the individual.

The sling 100 also includes a central axis 128. The central axis 128 bisects the central support section 102, the superior support section 104, and the inferior support section 108 such that the sling 100 is foldable about the central axis 128. Accordingly, when the sling 100 is used to rotate an individual, the central axis 128 acts as a fulcrum for rotating the individual. In various embodiments, the individual is rotated about an axis parallel to the long axis of the body extending through the axilla of the individual, midway between its anterior and posterior surfaces, sometimes referred to as the midaxillary line (202 in FIG. 2).

The sling 100 can be formed from any suitable material. In various embodiments, the central support section 102, the superior support section 104, and the inferior support section 108 can be a single piece of material. However, in other embodiments, each section may be formed independently and the pieces may be joined together. In various embodiments, the sling 100 is formed from a pliable material selected from nylon, a cotton polyester blend, or polyester. In some embodiments, the central support section 102 may be formed from a material selected from nylon, a cotton polyester blend, or polyester while one or both of the superior support section 104 and the inferior support section 108 are formed from a different material. Other materials are contemplated, provided that they have sufficient strength to support the weight of the individual during lifting and rotation.

In various embodiments, at least one surface of the material is coated with a coating to reduce friction. For example, the surface that is positioned away from the individual (e.g., the "outside" of the sling 100), may be coated with a polytetrafluoroethylene coating (e.g., TEFLON®, available from DuPont Co.). Other coatings may be employed to reduce friction, thereby increasing the ease with which the sling 100 can be positioned between the individual and the surface upon which they are disposed.

As shown in FIG. 1, in various embodiments, the sling 100 may include reinforcing webbing 130 to strengthen at least the central support section 102. The webbing 130 may further reinforce the superior support section 104 and/or the inferior support section 108. For example, as shown in FIG. 1, the webbing 130 extends from the central support section 102 into the inferior support section 108. The webbing 130 may be positioned in any suitable manner. In various embodiments, such as the embodiment depicted in FIG. 1, the webbing 130 extends along the first side 106 of the central support section 102 from a first lateral side 122 to a second lateral side 122, along at least a portion of the second side 110 of the central support section 102, and along at least a portion of the central axis 128 within the central support section 102. In some embodiments, the webbing 130 may further extend diagonally from an intersection of the first side 106 of the central support section and the first lateral side 122 to an intersection of the second side 110 of the central support section and the second lateral side 122 and from an intersection of the second side 110 of the central support section and the first lateral side 122 to an intersection of the first side 106 of the central support section and the second lateral side 122, as shown in FIG. 1. It is contemplated that webbing 130 may be positioned in other areas of the sling 100, such as areas that are determined to support a large portion of the load or may otherwise benefit from the reinforcement. The webbing 130 may be formed of any suitable material. For example, in various embodiments, the webbing 130 may be formed from a woven nylon strap, such as a strap formed from ballistic nylon.

While the slings 100 are described and depicted herein as comprising reinforcing webbing, it should be understood that this webbing is optional and that, in some embodiments, the slings 100 are formed without webbing, such as when at least the central support section 102 of the sling is formed from a pliable material with sufficient tensile strength to support an individual during lifting without any further reinforcement.

In FIG. 1, the straps 120 are illustrated as being formed from the webbing 130. In particular, the webbing 130 extends beyond the central support section 102 to form the straps 120 extending from each of the lateral sides 122 of the central support section 102. In such embodiments, the straps 120 may be strengthened because they are sewn into the central support section 102 over a greater area.

Figure 2:
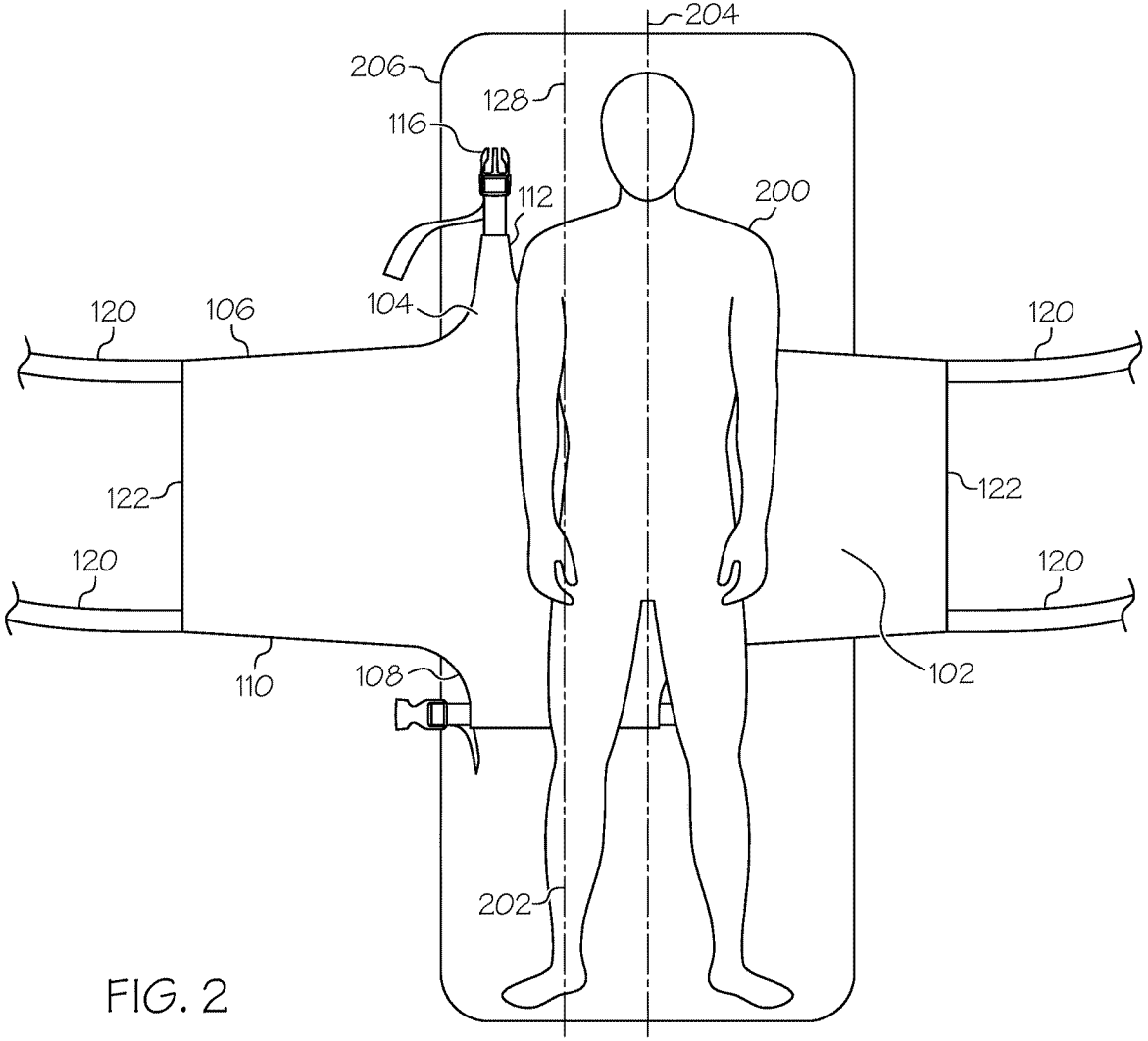
FIG. 2 schematically depicts a sling positioned to rotate an individual according to one or more embodiments.

Having described the sling 100 in detail, rotation of an individual using the sling 100 will now be described with specific reference to FIGS. 2-4. FIG. 2 schematically depicts an individual 200. For reference during rotation of the individual 200, FIG. 2 shows a midaxillary line 202 extending through the axilla of the individual, midway between its anterior and posterior surfaces, and a vertical axis of the individual 204 of symmetry extending through the head of the individual between the legs, dividing the individual into left and right halves.

In FIG. 2, the individual 200 is positioned on a supporting surface 206. The supporting surface 206 can be a bed (including or excluding a mattress), gurney, table, or other surface that supports an individual. In the embodiment shown in FIG. 2, the individual 200 is positioned face-up on the supporting surface 206. However, it should be understood that the initial position of the individual may be face down or, alternatively, the individual may be initially positioned on their side. The sling 100 is positioned between the individual 200 and the supporting surface 206. In some embodiments, a caregiver or other individual that will rotate the individual 200 will fold the sling 100 and push the sling 100 between the individual 200 and the supporting surface 206. For example, the superior support section 104 and the inferior support section 108 may be folded in toward the central support section 102. The central support section 102 may be folded one or more additional times to reduce the surface area of the sling 100 in contact with the individual 200 and the supporting surface 206. In embodiments in which a coating is employed to reduce friction, the sling 100 is folded such that the coated surface of the sling 100 is in contact with the supporting surface 206 and/or the individual 200. The sling 100 may also include one or more pockets (not shown) in which the caregiver inserts his or her hands (or a slender rod) to push the sling 100 between the supporting surface 206 and the individual 200.

In various embodiments, the central axis 128 of the sling 100 is aligned with the midaxillary line 202 of the individual 200. In some embodiments, the central axis 128 can be aligned with another vertical axis of the individual that lies in a parasagittal plane and does not form an axis of symmetry for the individual. Put another way, the sling 100 may be positioned such that the central axis 128 is not within the mid-sagittal plane 800 of the individual 200 (see FIG. 8, below).

Once positioned between the individual 200 and the supporting surface 206, the caregiver may unfold the sling 100 and vertically align the sling with the individual 200. As shown in FIG. 2, the central support section 102 is positioned below a torso of the individual 200, with the superior support section 104 being positioned below a shoulder of the individual 200 and the inferior support section 108 being positioned below a leg of the individual 200.

Once the sling 100 is in position, the fastening mechanisms 116 and 118 may be secured. As shown in FIG. 3, the sling 100 is folded about its central axis 128 about the individual 200. Before folding the sling 100 about the individual 200, the individual's arm may be raised to enable the central axis 128 to be positioned in alignment with the midaxillary line 202 of the individual 200. The anterior support flap 112 of the superior support section 104 is brought around the individual and the fastening mechanism 116 is secured near the shoulder of the individual 200. Accordingly, the anterior support flap 112 and the posterior support flap 114 (not shown in FIG. 3) are releasably secured.

Similarly, the inferior support section 108 is folded along the central axis 128 and is wrapped about the leg of the individual 200. The fastening mechanism 118 is secured to releasably secure the inferior support section 108 of the sling 10 around a portion of the leg of the individual 200. As shown in FIG. 3, in various embodiments, the inferior support section 108 is secured about the thigh of the individual, although in various embodiments, the particular position of the fastening mechanism 118 along the leg may vary. For example, in some embodiments, the inferior support section 108 may be secured about a knee, calf, or even ankle of the individual 200. It should be appreciated that the height of the individual 200 as well as the dimensions of the sling 100 can affect the location of the inferior support section 108 relative to the leg of the individual 200.

In embodiments that include a ring along the straps, the straps along one of the lateral sides may be threaded through the ring positioned along a proximate strap when the sling is folded along the central axis 128. For example, a first strap extending from the first side 106 of the central support section 102 may be threaded through a ring positioned along a second strap extending from the first side 106 of the central support section, while a first strap extending from the second side 110 of the central support section 102 may be threaded through a ring positioned along a second strap extending from the second side 110 of the central support section 102 to secure the sling 100 about the torso of the individual 200.

The sling 100 is then coupled to the lift mechanism (not shown). For example, the end loops 124 of the straps 120 may be secured to a hook on the lift mechanism. After the sling is coupled to the lift mechanism, the lift mechanism is activated to lift the individual 200 above the supporting surface 206, as shown in FIG. 4. In various embodiments, a portion of the individual's weight may be supported by the supporting surface 206 when the individual 200 is lifted. In other words, the individual 200 is lifted such that the individual 200 partially contacts the surface upon which the individual is disposed, as shown in FIG. 4. For example, at least a portion of the individual 200 may remain in contact with or lightly rest on the supporting surface 206 while he or she is lifted.

In some embodiments, the individual 200 is repositioned with respect to the supporting surface 206 before or during the lifting process. For example, the individual may be repositioned horizontally with respect to the supporting surface 206 to make room for the rotation of the individual. Repositioning can be performed before the individual 200 is lifted (e.g., while the individual is in the supine position as shown in FIG. 3) or as the individual 200 is lifted. For example, the lift mechanism may be engaged to lift the individual 200 into the position illustrated in FIG. 4 before the individual 200 is repositioned to be closer to the edge of the supporting surface 206. Horizontal repositioning of the individual 200 while the individual 200 is supported by the lift mechanism can reduce the force applied by the caregiver to reposition the individual 200.

Figure 4:
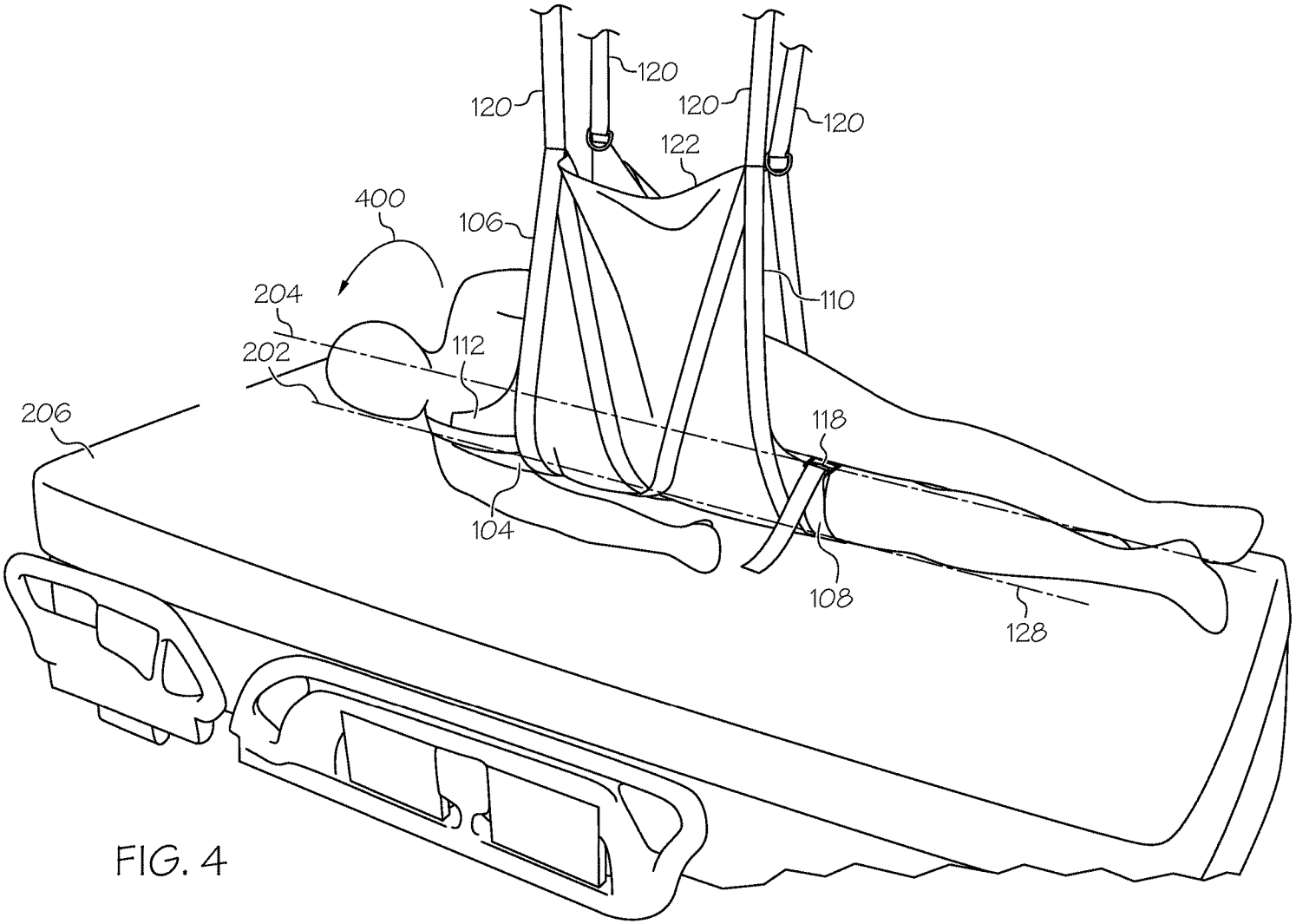
FIG. 4 schematically depicts a sling secured about an individual during rotation according to one or more embodiments.

As shown in FIG. 4, as the lift mechanism is engaged, the sling 100 is lifted, along with the individual 200, and the central axis 128 acts as a fulcrum for rotating the individual 200. In the embodiment depicted in FIG. 4, the sling 100 and individual 200 are lifted such that at least a portion of the individual 200 partially contacts the surface upon which the individual 200 is disposed. Because the individual 200 is secured in place with respect to the sling 100, the individual 200 is rotated about the midaxillary line 202, rather than the vertical axis of the individual 204. The caregiver or individual rotating the individual 200 may apply a force 400 to the individual 200. The force 400 may be applied along a sagittal axis, perpendicular to the coronal plane that divides the individual into anterior and posterior halves. The force 400 may be applied to one or more of the individual's shoulder, hip, or torso and should be sufficient to cause the shoulder and hip of the individual 200 to rotate about the midaxillary line 202 shown in FIG. 4. In embodiments such as the one shown in FIG. 4 where the individual 200 is being rotated in a counterclockwise direction from a supine to a prone position, the force 400 may be applied to the individual's left side to cause the individual's left shoulder and hip to rotate about the midaxillary line 202 along the right side of the individual's body. It should be understood that the individual can similarly be rotated in a clockwise direction where the force 400 is applied to the individual's right side to cause the individual's right shoulder and hip to rotate about the midaxillary line along the left side of the individual's body.

Figure 5:
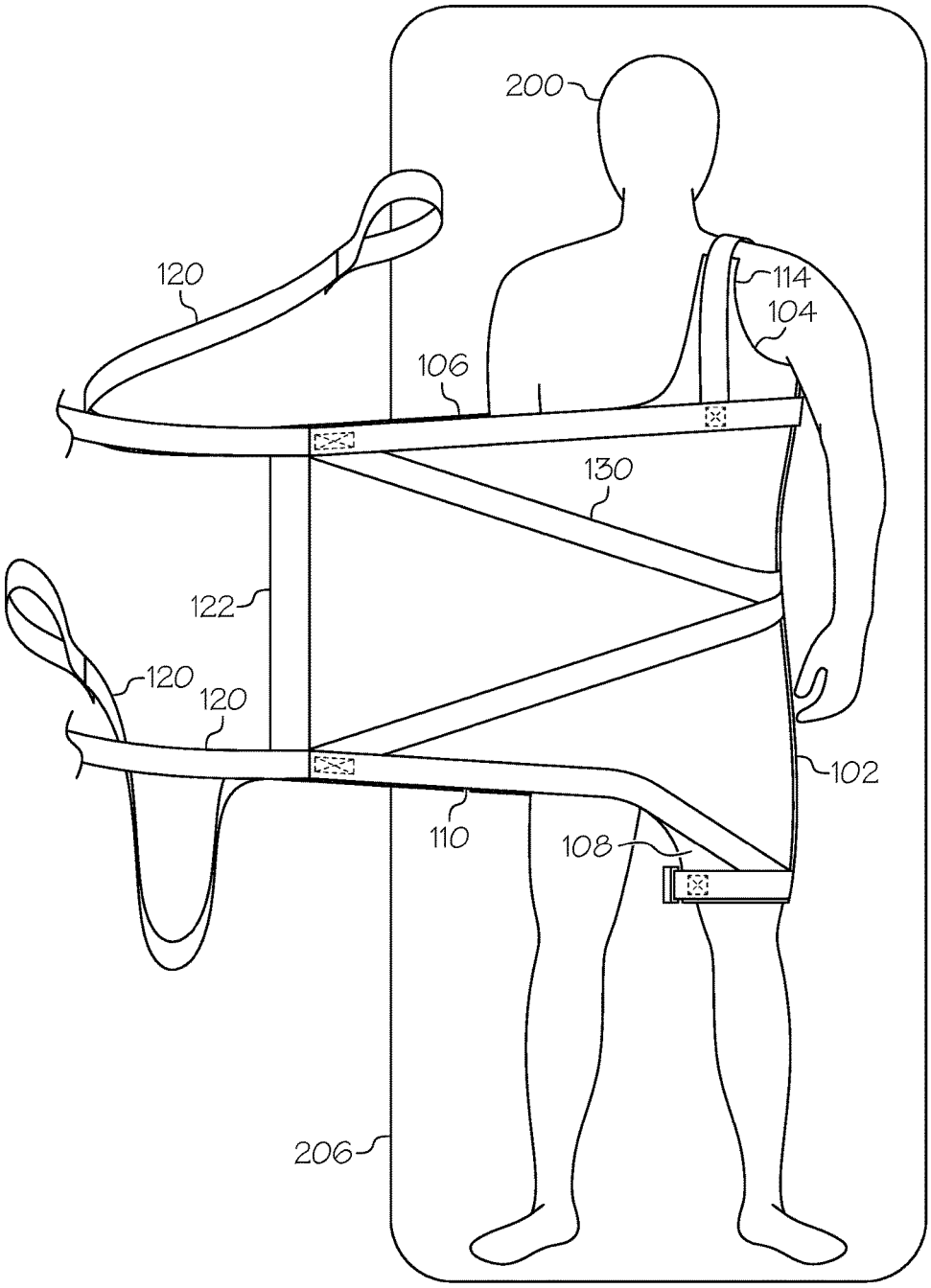
FIG. 5 schematically depicts a sling secured about an individual after rotation according to one or more embodiments.

As the individual 200 is rotated about the midaxillary line 202 and the central axis 128 of the sling 100, the lift mechanism is activated to lower the individual 200 back onto the supporting surface 206, as shown in FIG. 5. The individual 200 may be further horizontally repositioned with respect to the supporting surface 206 as the individual 200 is lowered onto the supporting surface 206. In various embodiments, the lift mechanism is activated in a manner to slowly lower the individual 200 onto the supporting surface 206 such that the individual is lowered onto an anterior side of the torso of the individual 200 such that the individual 200 is in a prone position. It is contemplated, however, that the sling 100 can be used to rotate the individual 200 from a prone position into a supine position, or to rotate the individual 200 onto a side.

In various embodiments, during rotation of the individual, the central support section 102 is sized to at least partially encircle the individual when the sling 100 is folded about the central axis 128. In other words, the central support section 102 provides support to the anterior and posterior sides of the torso of the individual 200 during rotation. Additionally, because the sling 100 supports the individual 200 throughout the rotation and transfers much of the individual's weight, a single caregiver may rotate an individual and may exert less force than in traditional methods of rotating or repositioning individuals.

The sling 100, and in particular, the central support section 102, the superior support section 104, and the inferior support section 108, may be modified to provide further support and comfort to the individual being rotated. For example, some embodiments may include one or more apertures in the central support section 102, the superior support section 104, or the inferior support section 108 to accommodate tubes, lines, wires, and/or other equipment connected to the individual. In some embodiments, various sections of the sling 100 may be modified or sized for improved ergonomics or style. As but one example, the superior support section 104 may be formed with a scalloped portion to accommodate the individual's arm, shoulder, and/or axilla.

Figure 6:
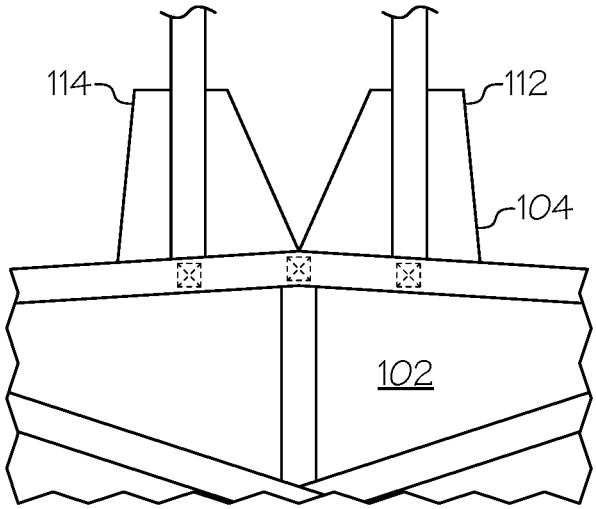
FIG. 6 schematically depicts an alternative embodiment of a superior support section of a sling according to one or more embodiments.
Figure 7:
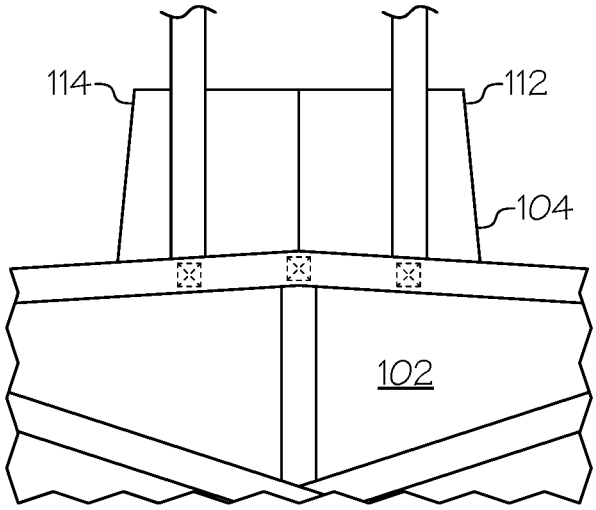
FIG. 7 schematically depicts another alternative embodiment of a superior support section of a sling according to one or more embodiments.

In various embodiments, at least a portion of the anterior support flap 112 is separated from at least a portion of the posterior support flap 114. In some embodiments, at least a portion of the anterior support flap 112 is spaced apart from at least a portion of the posterior support flap 114. The portions of the anterior support flap 112 and the posterior support flap 114 can be spaced apart, such as when an area between the anterior support flap 112 and the posterior support flap 114 forms a U-shape (as shown in FIG. 1) or a V-shape (as shown in FIG. 6). In still other embodiments, the anterior support flap 112 and posterior support flap 114 may be separated, but may not be spaced apart from one another, as shown in FIG. 7.

Figure 8:
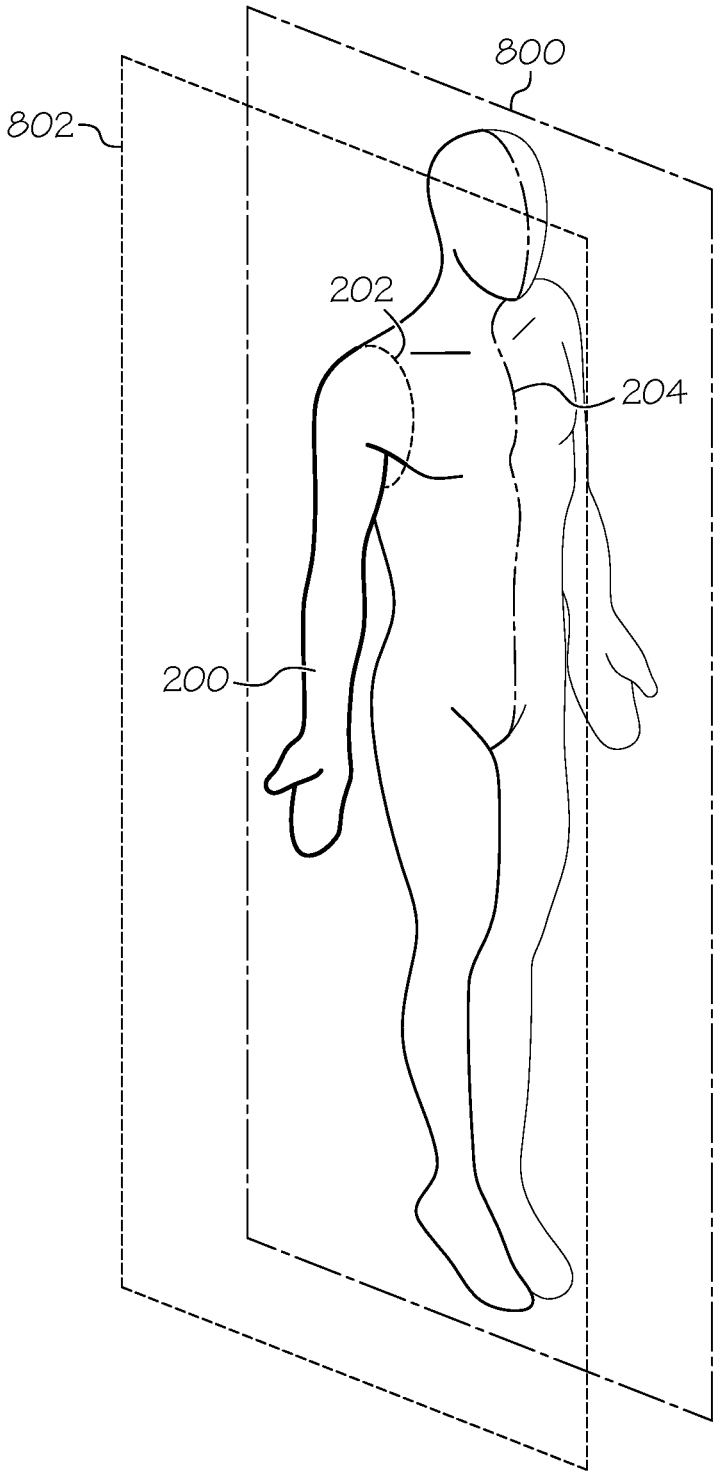
FIG. 8 schematically depicts various reference planes through an individual according to one or more embodiments.

FIG. 8 depicts various reference planes through an individual 200 and provides a general reference for the discussion hereinabove. In particular, FIG. 8 depicts a mid-sagittal plane 800 and a parasagittal plane 802. The mid-sagittal plane 800 is vertical and extends from the front of the body (anterior side) to the back of the body (posterior side). The mid-sagittal plane 800 divides the body into right and left sections and includes the vertical axis of the individual 204. The parasagittal plane 802 is parallel to the mid-sagittal plane 800. The parasagittal plane 802 is also vertical and extends from the front of the body to the back of the body, as shown in FIG. 8. The parasagittal plane 802 in FIG. 8 includes the midaxillary line 202. It should be understood that various parasagittal planes that are parallel to the mid-sagittal plane 800 exist, and axes for rotation of the individual can lie in any of these parasagittal planes. In particular, an individual will be rotated about a vertical axis in the parasagittal plane that also contains the central axis (not shown in FIG. 8) of the sling. As used herein, the terms "vertical axis of the individual" and "vertical" are used with respect to an individual in its standard anatomical position. In particular, the terms "vertical axis of the individual" and "vertical" are used with respect to an individual in a standing position. Accordingly, a vertical axis of the individual, as shown in FIGS. 2-5 may be horizontal when the individual is disposed on a surface in a supine or prone position.

Many additional embodiments other than those described above are possible and still included in the spirit and scope of the claims defining the embodiments described herein. For example, although various combinations of features of a sling have been shown and described, it is contemplated that these features may be combined in other ways described in detail or illustrated in the accompanying figures.

In a first aspect, the disclosure provides a sling for rotating an individual. The sling includes a central support section supporting at least a torso of the individual; a superior support section disposed along a first side of the central support section, the superior support section having an anterior support flap and a posterior support flap, at least a portion of the posterior support flap being separated from at least a portion of the anterior support flap; an inferior support section disposed along a second side of the central support section opposing the superior support section; straps extending from each lateral side of the central support section, each strap including an end loop for coupling to a lift mechanism; and a central axis bisecting the superior support section, the central support section, and the inferior support section such that the sling is foldable about the central axis, the central axis acting as a fulcrum for rotating the individual about a midaxillary line of the individual.

In a second aspect, the disclosure provides a sling including a central support section supporting at least a torso of the individual; a superior support section disposed along a first side of the central support section, the superior support section having an anterior support flap and a posterior support flap, at least a portion of the posterior support flap being separated from at least a portion of the anterior support flap, the superior support section including a fastening mechanism to releasably secure the anterior support flap and the posterior support flap; an inferior support section disposed along a second side of the central support section opposing the superior support section, the inferior support section including a fastening mechanism to releasably secure the inferior support section of the sling to itself and around a portion of a leg of the individual; at least one strap extending from each lateral side of the central support section, each strap including an end loop for coupling to a lift mechanism; and a central axis bisecting the superior support section, the central support section, and the inferior support section.

In a third aspect, the disclosure provides the sling of the first aspect in which the superior support section includes a fastening mechanism to releasably secure the anterior support flap to the posterior support flap.

In a fourth aspect, the disclosure provides the sling of the third or fourth aspects in which the inferior support section includes a fastening mechanism to releasably secure the inferior support section to itself.

In a fifth aspect, the disclosure provides a sling of the second through fourth aspects, wherein the fastening mechanism of the superior section includes a buckle and clip fastener.

In a sixth aspect, the disclosure provides a sling of any of the second through fifth aspects, wherein the fastening mechanism of the inferior support section includes a buckle and clip fastener.

In a seventh aspect, the disclosure provides a sling of any of the first through sixth aspects, wherein the central support section includes webbing strengthening the central support section.

In a eighth aspect, the disclosure provides a sling of any of the first through seventh aspects, wherein the webbing extends along the first side of the central support section from a first lateral side to a second lateral side, along at least a portion of the second side of the central support section, and along at least a portion of the central axis of the central support section.

In a ninth aspect, the disclosure provides a sling of any of the first through eighth aspects, wherein the webbing further extends diagonally from an intersection of the first side of the central support section and the first lateral side to an intersection of the second side of the central support section and the second lateral side and from an intersection of the second side of the central support section and the first lateral side to an intersection of the first side of the central support section and the second lateral side.

In a tenth aspect, the disclosure provides a sling of any of the first through ninth aspects, wherein the webbing extends beyond the central support section to form the straps extending from each of the lateral sides of the central support section.

In eleventh aspect, the disclosure provides a sling of any of the first through tenth aspects, wherein the central support section includes a material selected from nylon, a cotton polyester blend, or polyester.

In a twelfth aspect, the disclosure provides a sling of any of the first through eleventh aspects, wherein the material is coated with a coating to reduce friction.

In a thirteenth aspect, the disclosure provides a sling of any of the first through twelfth aspects, wherein the coating is polytetrafluoroethylene.

In a fourteenth aspect, the disclosure provides a sling of any of the first through thirteenth aspects, wherein the central support section is sized to at least partially encircle the individual when the sling is folded about the central axis.

In a fifteenth aspect, the disclosure provides a sling of any of the first through fourteenth aspects, wherein the straps include a first strap extending from a first of the lateral sides of the central support section proximate the first side of the central support section; a second strap extending from a second of the lateral sides of the central support section proximate the first side of the central support section; a third strap extending from the first of the lateral sides of the central support section proximate the second side of the central support section; and a fourth strap extending from the second of the lateral sides of the central support section proximate the second side of the central support section.

In a sixteenth aspect, the disclosure provides a sling of any of the first through fifteenth aspects, further including a ring positioned along the first strap to receive the second strap and a ring positioned along the third strap to receive the fourth strap.

In a seventeenth aspect, the disclosure provides a sling of any of the first through sixteenth aspects, further including at least one ring positioned along one of the straps to receive another of the straps.

In a eighteenth aspect, the disclosure provides a sling of any of the first through seventeenth aspects, further including one or more apertures in the central support section to accommodate tubes connected to the individual.

According to a nineteenth aspect, the disclosure provides a method of rotating an individual. The method includes positioning a sling between the individual and a surface upon which the individual is disposed, the sling comprising: a central support section supporting at least a torso of the individual; a superior support section disposed along a first side of the central support section, the superior support section having an anterior support flap and a posterior support flap, at least a portion of the posterior support flap being separated from at least a portion of the anterior support flap; an inferior support section disposed along a second side of the central support section opposing the superior support section; at least one strap extending from each lateral side of the central support section, each strap including an end loop for coupling to a lift mechanism; and a central axis bisecting the superior support section, the central support section, and the inferior support section. The method further includes positioning the central axis of the sling such that the central axis is not aligned with a mid-sagittal plane of the individual; and lifting the sling and the individual with the at least one strap extending from each lateral side of the central support section such that at least a portion of the individual contacts the surface upon which the individual is disposed, wherein the central axis acts as a fulcrum for rotating the individual, wherein, as the individual is lifted, the individual is rotated about a vertical axis of the individual within a parasagittal plane of the individual.

According to a twentieth aspect, the disclosure provides a method according to the nineteenth aspect in which the method further includes positioning the anterior support flap and the posterior support flap relative to a first shoulder of the individual.

According to a twenty-first aspect, the disclosure provides a method according to the twentieth aspect in which the superior support section includes a fastening mechanism to releasably secure the anterior support flap to the posterior support flap and the method further comprises releasably securing the anterior support flap to the posterior support flap about the first shoulder of the individual with the fastening mechanism.

According to a twenty-second aspect, the disclosure provides a method according to the nineteenth through twenty-first aspects in which the method further includes positioning the inferior support section of the sling around a first leg of the individual.

According to a twenty-third aspect, the disclosure provides a method according to the twenty-second aspect in which the inferior support section includes a fastening mechanism to releasably secure the inferior support section to itself and the method further comprises securing the inferior support section to itself around the first leg of the individual with the fastening mechanism.

According to a twenty-fourth aspect, the disclosure provides a method according to the nineteenth through twenty-third aspects in which the method further includes rotating the individual about the central axis by applying a force to the individual to rotate a hip and a second shoulder of the individual about the central axis; and lowering the individual onto the surface upon which the individual is disposed, wherein the individual is lowered onto an anterior side of the torso of the individual.

According to a twenty-fifth aspect, the disclosure provides a method according to the nineteenth through twenty-fourth aspects in which the at least one strap comprises: a first strap extending from a first of the lateral sides of the central support section proximate the first side of the central support section; a second strap extending from a second of the lateral sides of the central support section proximate the first side of the central support section; a third strap extending from the first of the lateral sides of the central support section proximate the second side of the central support section; and a fourth strap extending from the second of the lateral sides of the central support section proximate the second side of the central support section.

According to a twenty-sixth aspect, the disclosure provides a method according to the twenty-fifth aspect in which the method further comprises threading the second strap through a ring positioned along the first strap; and threading the fourth strap though a ring positioned along the third strap, wherein threading the second strap and the fourth strap through the rings secures the central support section around the torso of the individual.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A sling for rotating an individual, the sling comprising:

a central support section supporting at least a torso of the individual;

a superior support section disposed along a first side of the central support section, the superior support section having an anterior support flap and a posterior support flap, at least a portion of the posterior support flap being separated from at least a portion of the anterior support flap;

an inferior support section disposed along a second side of the central support section opposing the superior support section;

straps extending from each lateral side of the central support section, each strap including an end loop for coupling to a lift mechanism; and a central axis bisecting the superior support section, the central support section, and the inferior support section such that the sling is foldable about the central axis, the central axis acting as a fulcrum for rotating the individual about a midaxillary line of the individual; wherein:

the superior support section includes a fastening mechanism to releasably secure the anterior support flap to the posterior support flap to maintain the individual in position with respect to the sling during rotation of the individual about the midaxillary line of the individual.

2. The sling of claim 1, wherein the fastening mechanism of the superior support section comprises a buckle and clip fastener.

3. The sling of claim 1, wherein the inferior support section includes a fastening mechanism to releasably secure the inferior support section to itself.

4. The sling of claim 3, wherein the fastening mechanism of the inferior support section comprises a buckle and clip fastener.

5. The sling of claim 1, wherein the central support section comprises webbing strengthening the central support section.

6. The sling of claim 5, wherein the webbing extends along the first side of the central support section from a first lateral side to a second lateral side, along at least a portion of the second side of the central support section, and along at least a portion of the central axis of the central support section.

7. The sling of claim 6, wherein the webbing further extends diagonally from an intersection of the first side of the central support section and the first lateral side to an intersection of the second side of the central support section and the second lateral side and from an intersection of the second side of the central support section and the first lateral side to an intersection of the first side of the central support section and the second lateral side.

8. The sling of claim 5, wherein the webbing extends beyond the central support section and forms the straps extending from each lateral side of the central support section.

9. The sling of claim 1, wherein the central support section comprises a material selected from nylon, a cotton polyester blend, or polyester.

10. The sling of claim 9, wherein the material is coated with a coating to reduce friction.

11. The sling of claim 10, wherein the coating is polytetrafluoroethylene.

12. The sling of claim 1, wherein the central support section is sized to at least partially encircle the individual when the sling is folded about the central axis.

13. The sling of claim 1, wherein the straps comprise:

a first strap extending from a first of the lateral sides of the central support section proximate the first side of the central support section;

a second strap extending from a second of the lateral sides of the central support section proximate the first side of the central support section;

a third strap extending from the first of the lateral sides of the central support section proximate the second side of the central support section; and a fourth strap extending from the second of the lateral sides of the central support section proximate the second side of the central support section.

14. The sling of claim 13, further comprising:

a ring positioned along the first strap to receive the second strap; and a ring positioned along the third strap to receive the fourth strap.

15. The sling of claim 1, further comprising at least one ring positioned along one of the straps to receive another of the straps.

16. A method of rotating an individual, the method comprising:

positioning a sling between the individual and a surface upon which the individual is disposed, the sling comprising:

a central support section supporting at least a torso of the individual;

a superior support section disposed along a first side of the central support section, the superior support section having an anterior support flap and a posterior support flap, at least a portion of the posterior support flap being separated from at least a portion of the anterior support flap;

an inferior support section disposed along a second side of the central support section opposing the superior support section;

at least one strap extending from each lateral side of the central support section, each strap including an end loop for coupling to a lift mechanism; and a central axis bisecting the superior support section, the central support section, and the inferior support section;

positioning the central axis of the sling such that the central axis is not aligned with a mid-sagittal plane of the individual;

lifting the sling and the individual with the at least one strap extending from each lateral side of the central support section such that at least a portion of the individual contacts the surface upon which the individual is disposed, wherein the central axis acts as a fulcrum for rotating the individual, wherein, as the individual is lifted, the individual is rotated about a vertical axis of the individual within a parasagittal plane of the individual;

positioning the anterior support flap and the posterior support flap relative to a first shoulder of the individual, wherein the superior support section includes a fastening mechanism to releasably secure the anterior support flap to the posterior support flap; and releasably securing the anterior support flap to the posterior support flap about the first shoulder of the individual with the fastening mechanism to maintain the individual in position with respect to the sling during rotation of the individual about the midaxillary line of the individual.

17. The method of claim 16, further comprising positioning the inferior support section of the sling around a first leg of the individual.

18. The method of claim 17, wherein the inferior support section includes a fastening mechanism to releasably secure the inferior support section to itself and the method further comprises securing the inferior support section to itself around the first leg of the individual with the fastening mechanism.

19. The method of claim 16, further comprising:

rotating the individual about the central axis by applying a force to the individual to rotate a hip and a second shoulder of the individual about the central axis; and lowering the individual onto the surface upon which the individual is disposed, wherein the individual is lowered onto an anterior side of the torso of the individual.

20. The method of claim 16, wherein the at least one strap comprises:

a first strap extending from a first of the lateral sides of the central support section proximate the first side of the central support section;

a second strap extending from a second of the lateral sides of the central support section proximate the first side of the central support section;

a third strap extending from the first of the lateral sides of the central support section proximate the second side of the central support section; and a fourth strap extending from the second of the lateral sides of the central support section proximate the second side of the central support section.

21. The method of claim 20, further comprising:

threading the second strap through a ring positioned along the first strap; and threading the fourth strap through a ring positioned along the third strap;

wherein threading the second strap and the fourth strap through the rings secures the central support section around the torso of the individual.

* * * * *